US010858838B1

(12) United States Patent
Ng

(10) Patent No.: US 10,858,838 B1
(45) Date of Patent: Dec. 8, 2020

(54) DEBRIS DIVERSION AND REMOVAL IN A GUTTER

(71) Applicant: Kim Kwee Ng, Centereach, NY (US)

(72) Inventor: Kim Kwee Ng, Centereach, NY (US)

( * ) Notice: Subject to any disclaimer, the term of this patent is extended or adjusted under 35 U.S.C. 154(b) by 0 days.

(21) Appl. No.: 16/667,732

(22) Filed: Oct. 29, 2019

(51) Int. Cl.
*E04D 13/076* (2006.01)
*E04D 13/064* (2006.01)

(52) U.S. Cl.
CPC ..... *E04D 13/076* (2013.01); *E04D 13/064* (2013.01)

(58) Field of Classification Search
CPC ..... E04D 13/064; E04D 13/076
See application file for complete search history.

(56) References Cited

U.S. PATENT DOCUMENTS 956,372 A * 4/1910 Kreutzberg ..... B01D 29/111 210/460
1,930,354 A * 10/1933 Greene ..... E04D 13/0409 210/463
2,229,381 A * 1/1941 Grow ..... E04D 13/076 52/12
4,241,547 A * 12/1980 Bove' ..... E04D 13/076 52/11
4,253,281 A * 3/1981 Ruttenberg ..... E04D 13/076 210/400
4,634,312 A * 1/1987 Sterzel ..... E03F 9/00 134/166 C
4,709,516 A * 12/1987 Gleaves ..... E04D 13/076 52/11
4,852,308 A * 8/1989 Papenbrock ..... E04D 13/076 52/12
4,905,427 A * 3/1990 McPhalen ..... E04D 13/076 210/474
4,949,514 A * 8/1990 Weller ..... E04D 13/076 210/474
4,964,247 A * 10/1990 Spica ..... E04D 13/076 52/11
5,092,086 A * 3/1992 Rognsvoog, Sr. .... E04D 13/076 248/48.1
5,103,601 A * 4/1992 Hunt ..... E04D 13/076 210/474
5,274,965 A * 1/1994 Jackson ..... E04D 13/076 16/389
5,526,611 A * 6/1996 Leahy ..... E04D 13/0645 52/11
5,536,406 A * 7/1996 Silva ..... B01D 29/33 210/460
5,548,931 A * 8/1996 Bryant ..... E04D 13/076 248/48.2
5,575,118 A * 11/1996 Vahldieck ..... E04D 13/076 52/11
5,678,359 A * 10/1997 Turner ..... E04D 13/064 52/105

(Continued)

*Primary Examiner* — James M Ference

(57) ABSTRACT

A canal with a declining slope is provided to allow the rainwater to flow from a higher altitude to a lower level in a gutter. The force from the running water flowing in the canal helps to push the debris down toward an opening of the gutter. A wire mesh is used to prevent larger debris from entering the gutter. The debris which enters through the wire mesh is to stream with the rainwater in the declined canal to a lower level to eventually exit from the gutter. A debris remover is also configured to remove the debris in the gutter.

20 Claims, 1 Drawing Sheet

(56) References Cited

U.S. PATENT DOCUMENTS 5,845,435 A * 12/1998 Knudson ..... E04D 13/076 52/11
5,865,498 A * 2/1999 Grogan ..... B60P 3/36 296/163
5,867,945 A * 2/1999 Scafidi ..... E04D 13/0765 52/11
RE36,343 E * 10/1999 Silva ..... B01D 29/33 210/460
5,989,357 A * 11/1999 Vilhauer, Jr. ..... E04D 13/076 134/104.1
6,293,054 B1 * 9/2001 Cangialosi ..... E04D 13/076 210/474
6,314,685 B1 * 11/2001 Sullivan ..... E04D 13/064 52/11
6,672,012 B2 * 1/2004 Bahroos ..... E04D 13/076 210/162
6,732,477 B1 * 5/2004 Richard ..... E04D 13/0725 248/48.1
6,823,630 B2 * 11/2004 Marra ..... E04D 13/076 248/48.1
6,964,135 B1 * 11/2005 Slodov ..... E04D 13/0765 52/11
7,174,676 B1 * 2/2007 Armstrong ..... E04D 13/076 52/11
9,725,909 B2 * 8/2017 Ward ..... E04D 13/0767
10,125,496 B2 * 11/2018 Lenney ..... E04D 13/076
2003/0033756 A1 * 2/2003 Adams ..... E04D 13/076 52/11
2003/0070366 A1 * 4/2003 Beyers ..... E04D 13/076 52/12
2003/0089046 A1 * 5/2003 Stevens ..... E04D 13/076 52/11
2003/0091392 A1 * 5/2003 Bevilacqua ..... E04D 13/076 405/48
2004/0187394 A1 * 9/2004 Brochu ..... E04D 13/076 52/12
2004/0223807 A1 * 11/2004 Bevilacqua ..... F16L 9/22 404/7
2004/0244302 A1 * 12/2004 Neumann ..... E04D 13/076 52/11
2005/0279036 A1 * 12/2005 Brochu ..... E04D 13/0643 52/287.1
2008/0163561 A1 * 7/2008 Lenney ..... E04D 13/076 52/12
2009/0183438 A1 * 7/2009 Walker ..... E04D 13/0765 52/11
2009/0288349 A1 * 11/2009 Wootton ..... E04D 13/076 52/12
2011/0047887 A1 * 3/2011 Contreras ..... E04D 13/076 52/12
2012/0174494 A1 * 7/2012 Ollison, IV ..... E04D 13/076 52/12
2013/0067830 A1 * 3/2013 Sharkey ..... E04D 13/076 52/12
2013/0283707 A1 * 10/2013 Ratajac ..... E04D 13/076 52/12
2016/0376790 A1 * 12/2016 Yildiz ..... E04D 13/064 52/12
2017/0204613 A1 * 7/2017 Harcrow, Jr. ..... E04D 13/064

* cited by examiner

DEBRIS DIVERSION AND REMOVAL IN A GUTTER

CROSS-REFERENCE TO RELATED APPLICATIONS

None.

FIELD OF THE INVENTION

The present invention relates to systems and methods for diverting and removing debris from a gutter, and, more particularly, to a canal carrying debris away from the gutter.

BACKGROUND OF THE INVENTION

Gutters are commonly used in many homes for diverting rainwater away from the rooftop of the houses. A traditional gutter has a flat bottom for the flow of the rainwater. The debris has a tendency to stay in the flat bottom of the gutter. To clear the debris which has been accumulated over time is often a tedious and dangerous job.

In the past, a wire mesh has been used, but it can only prevent large debris from entering the gutter. The disadvantage of using filtering woven material or the like to cover the gutter is the likely scenario that the woven material may itself get clogged. Besides, the resulting tightly enclosed space, in the absence of sunlight and air circulation, becomes an attractive place for inducing the growth of slimy mold inside the gutter.

BRIEF SUMMARY OF THE INVENTION

A canal with a declining slope is configured to allow the rainwater coming from the rooftop of a house to flow from a higher altitude to a lower level in a gutter. The force from the running water flowing in the canal helps to push the debris down toward an opening of the gutter.

A wire mesh is used to prevent bigger debris from entering the gutter. The debris which passes through the wire mesh is to stream with the rainwater in the declined canal to a lower level to eventually exit from the gutter. An open-top container containing the canal is tilted in a way that allows excess rainwater to flow out into the gutter. A debris remover is also configured to remove the debris in the gutter.

DETAILED DESCRIPTION OF THE INVENTION

Figure 1:
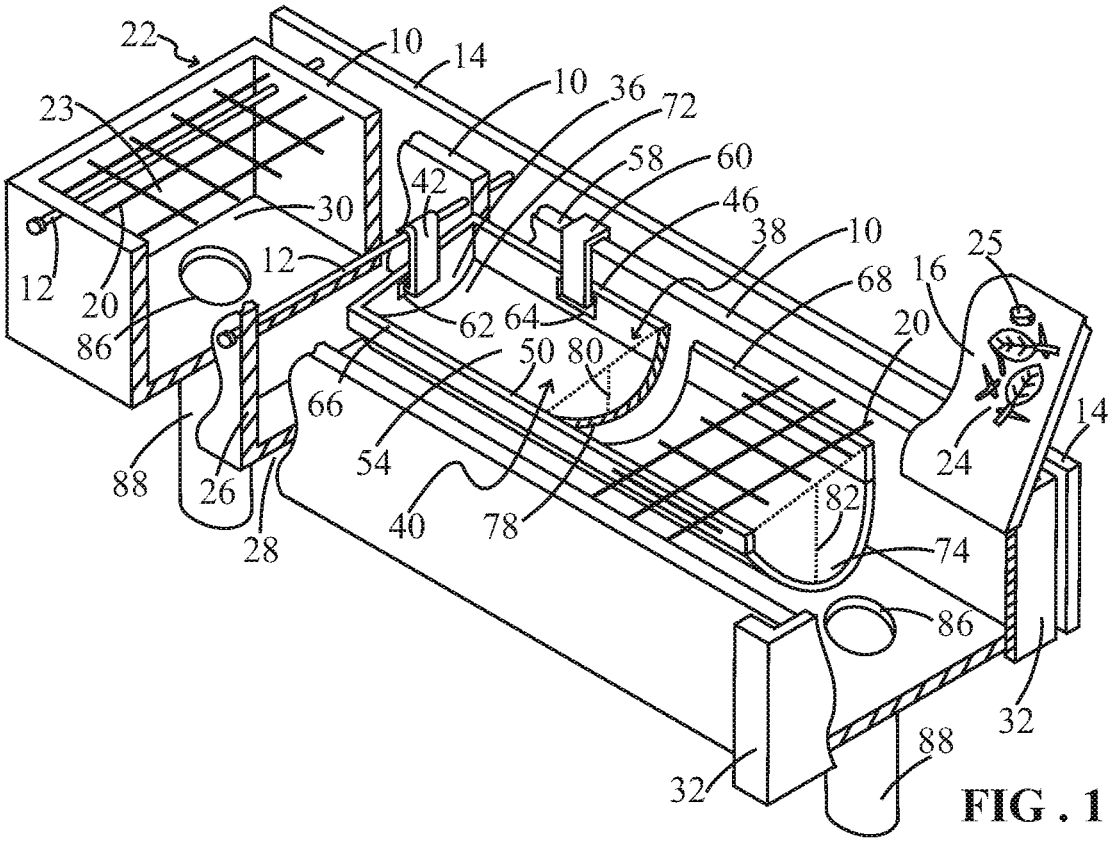
FIG. 1 is a simplified diagram of a preferred embodiment having an open-top container which comprises a canal being installed inside a gutter.

In an embodiment shown in FIG. 1, a gutter 10 is mounted by a plurality of nails 12 to a fascia board 14 under the roof 16 of a house. The gutter 10 is covered by a mesh screen or wire mesh 20 (only several portions of the wire mesh is shown) which is secured to the top 22 of the gutter 10 by a plurality of hooks (not shown) to the nails 12. The wire mesh 20, having a plurality of openings 23, is to serve as a blocker means that filters out any debris 24 which is larger than the openings 23 in the wire mesh 20. The openings 23 are made as small as possible, leaving only some small solid material, which is usually become dissociated from the shingles, and small lumpy particles 25 to enter the gutter 10.

A cut-off section 26 shown in FIG. 1 is at a mid-point 28 between the distal end 30 and an endcap 32 of the gutter 10. A side 36 of an open-top container 38, which is defined and assigned to be used as a channel or canal 40, is mounted to one of the nails 12 using a first hook 42.

The canal 40 is bounded on three sides and comprises a rear barrier 46, a front barrier 50 and a bottom 54. The rear barrier 46 abuts against the rear wall 58 of the gutter 10 by using a second hook 60. The bottom portions of the hooks 42, 60 are bent and inserted respectively into the through openings 62, 64 provided by the open-top container 38. It is noted that the side 36 is not needed in the general use of the open-top container 38 when some extra hooks are used to mount the open-top container 38 to the rear wall 58 of the gutter 10.

The open-top container 38 containing the canal 40 is tilted in a way that allows excess rainwater to flow out from the front barrier 50 into the gutter 10. The front top edge 66 of the open-top container 38 is positioned at a lower altitude than the rear top edge 68 to allow any overflow water to flow out from the front top edge 66 of the open-top container 38 into the gutter 10.

The bottom 54 of the canal 40 is configured to provide a waterway which is an auxiliary declining pathway for the rainwater to flow. The beginning portion 72 of the canal 40, which starts near the mid-point 28 of the gutter 10, is at a higher altitude than the terminal end 74 of the canal 40 which is positioned at a lower level near the endcap 32. The bottom 54 of the canal 40 is thereby configured to have a declining slope to allow the rainwater to flow with a speed and force that helps to move the lumpy particles 25 toward the terminal end 74 of the canal 40.

A cut-off section 78 in the middle of the canal 40 has shown that the depth 80 of the canal 40 is smaller than the depth 82 at the terminal end 74 of the canal 40. The terminal end 74 of the canal 40 is positioned near an opening 86 in the gutter 10. This allows the water to flow down directly under the force of gravity along the canal 40 to the opening 86 in the gutter 10.

The water coming down from the roof 16 near the mid-point 28 of the gutter 10 flows at a higher altitude until it reaches the terminal end 74 which is at a lower level before pouring into the opening 86. The lumpy particles 25 which are smaller than the size of the openings 23 in the wire mesh 20 are dropped into the canal 40. The force of the continuously running water helps to push the lumpy particles 25 along in the canal 40 to the terminal end 74. The lumpy particles 25 are subsequently carried and streamed with the flowing water in the canal 40 to the opening 86. The water and the lumpy particles 25 are subsequently departed from the gutter 10 via a downspout 88.

Figure 2:
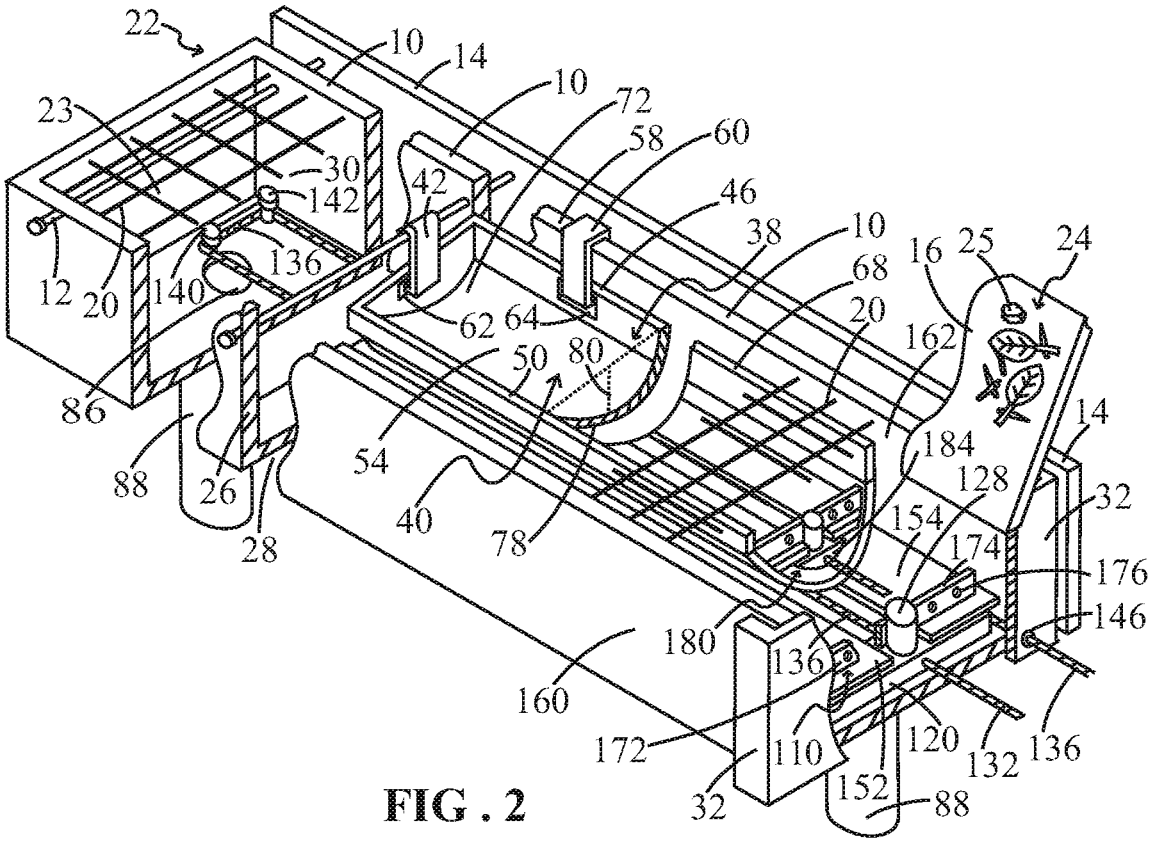
FIG. 2 shows the use of a plurality of debris removers for removing the debris in the gutter.

In FIG. 2, a movable debris remover 110 is employed to remove the lumpy particles 25 in the gutter 10. A movable rectangular base plate 120, having a guiding cylinder 128 at its center, is moved by a first flexible string 132 toward the endcap 32. The first flexible string 132 can be replaced by a high strength fiber cable, an endless chain or the like. The first flexible string 132 is attached to a side of the rectangular base plate 120. A second flexible string 136 is attached to the opposite side of the rectangular base plate 120 to move the rectangular base plate 120 in the opposite direction toward the distal end 30 of the gutter 10. The second flexible string 136 passes around two rollers 140, 142 which are positioned near the distal end 30 of the gutter 10. The second flexible string 136 emerges from a hole 146 in the endcap 32.

The rectangular base plate 120 is constrained to move under two longitudinal plates 152, 154 which are spaced apart and mounted respectively to the front wall 160 and the rear wall 162 of the gutter 10. The guiding cylinder 128 is allowed to move in the gap between the two longitudinal plates 152, 154. Two vertical plates 172, 174 are mounted to the guiding cylinder 128 to face the lumpy particles 25. The vertical plates 172, 174 are to slide above the longitudinal plates 152, 154. The vertical plates 172, 174 are moved to push the lumpy particles 25 away toward the opening 86 when either the first flexible string 132 or the second flexible string 136 is pulled. The vertical plates 172, 174 comprise a plurality of through openings, called orifices 176 to allow the rainwater to flow.

Another debris remover 180 is similarly used to clear the lumpy particles 25 in the canal 40. The configuration of the debris remover 180 is the same as the debris remover 110, except that a curved slidable layer or curved base block 184 is used to replace the rectangular base plate 120. The curved base block 184 is adapted to have a similar shape as the bottom 54 of the canal 40, so that the debris remover 180 slides along on the bottom 54 of the canal 40 to remove the lumpy particles 25 deposited in the canal 40.

Having described the invention and its preferred mode of operation in sufficient detail for those of normal skill in the art to practice the same, it will be obvious to such practitioners to make certain changes and variations in the specific elements of the disclosed embodiments without departing from the scope of the invention. For these reasons, the scope of the invention should not be limited by that which has been illustrated herein but should be limited only by the scope of the appended claims:

What is claimed is:

1. A device for use with a gutter which is attached to a house where rainwater and debris are coming down from a roof of the house, comprising:

a) a container means defining a canal which comprises a front barrier, a rear barrier and a bottom which is configured to have a pathway whereby a depth of said pathway at a middle point section of said canal is smaller than a depth of said pathway at a terminal end of said canal in which the rainwater and debris are allowed to flow; and b) an exit means defining an opening in said gutter; said opening is positioned at the terminal end of said canal where the rainwater and debris are allowed to exit from said opening and depart from the gutter;

wherein the rainwater coming down from the roof of the house is running down in said pathway with a force that pushes the debris which has dropped into the canal; said pathway starts at a beginning portion of the canal and the debris carried by the rainwater is flowing toward the terminal end of the canal; said terminal end of the canal is positioned at a lower altitude than the beginning portion of the canal in the gutter; said debris carried by the rainwater which flows into said opening is subsequently allowed to depart from the gutter.

2. The device of claim 1, wherein said device comprises a wire mesh which has a plurality of openings through which the debris having a size smaller than the size of the openings is dropped into said canal.

3. The device of claim 1, wherein said device comprises a movable debris remover which slides on the bottom of the gutter.

4. The device of claim 3, wherein said device comprises a movable base plate for sliding on the bottom of the gutter.

5. The device of claim 3, wherein said device comprises a plurality of vertical plates which are used to push the debris in the gutter.

6. The device of claim 1, wherein said device comprises a movable debris remover which slides on the bottom of the canal.

7. The device of claim 6, wherein said device comprises a slidable curved base block for sliding on the bottom of the canal.

8. The device of claim 6, wherein said device comprises a plurality of vertical plates which are used to push the debris in the gutter.

9. The device of claim 1, wherein said container means is tilted to allow excess water to flow out from the front barrier into the gutter.

10. A device for use with a gutter which is attached to a house where rainwater and debris are coming down from a roof of the house, comprising:

a) a container means defining a canal which comprises a front barrier, a rear barrier and a bottom which is configured to have a pathway whereby a depth of said pathway at a middle point section of said canal is smaller than a depth of said pathway at a terminal end of said canal in which the rainwater and debris are allowed to flow; and b) a blocker means defining a wire mesh which has a plurality of openings through which the debris having a size smaller than the size of the openings is dropped into said canal; and c) an exit means defining an opening in said gutter; said opening is positioned at the terminal end of said canal where the rainwater and debris are allowed to exit from said opening and depart from the gutter;

wherein the rainwater coming down from the roof of the house is running down in said pathway with a force that pushes the debris which has dropped into the canal; said pathway starts at a beginning portion of the canal and the debris carried by the rainwater is flowing toward the terminal end of the canal; said terminal end of the canal is positioned at a lower altitude than the beginning portion of the canal in the gutter; said debris carried by the rainwater which flows into said opening is subsequently allowed to depart from the gutter.

11. The device of claim 10, wherein said device comprises a movable debris remover which slides on the bottom of the gutter.

12. The device of claim 11, wherein said device comprises a movable base plate for sliding on the bottom of the gutter.

13. The device of claim 11, wherein said device comprises a plurality of vertical plates which are used to push the debris in the gutter.

14. The device of claim 10, wherein said device comprises a movable debris remover which slides on the bottom of the canal.

15. The device of claim 14, wherein said device comprises a plurality of vertical plates which are used to push the debris in the gutter.

16. The device of claim 10, wherein said container means is tilted to allow excess water to flow out from the front barrier into the gutter.

17. A device for use with a gutter which is attached to a house where rainwater and debris are coming down from a roof of the house, comprising:

a) a container means defining a canal which comprises a front barrier, a rear barrier and a bottom which is configured to have a pathway whereby a depth of said pathway at a middle point section of said canal is smaller than a depth of said pathway at a terminal end of said canal in which the rainwater and debris are allowed to flow;

b) a remover means defining a movable debris remover which slides on the bottom of the gutter; and c) an exit means defining an opening in said gutter; said opening is positioned at the terminal end of said canal where the rainwater and debris are allowed to exit from said opening and depart from the gutter; wherein the rainwater coming down from the roof of the house is running down in said pathway with a force that pushes the debris which has dropped into the canal; said pathway starts at a beginning portion of the canal and the debris carried by the rainwater is flowing toward the terminal end of the canal; said terminal end of the canal is positioned at a lower altitude than the beginning portion of the canal in the gutter; said debris carried by the rainwater which flows into said opening is subsequently allowed to depart from the gutter.

18. The device of claim 17, wherein said device comprises a wire mesh which has a plurality of openings through which the debris having a size smaller than the size of the openings is dropped into said canal.

19. The device of claim 17, wherein said device comprises a plurality of vertical plates for pushing the debris in the gutter.

20. The device of claim 17, wherein said container means is tilted to allow excess water to flow out from the front barrier into the gutter.

* * * * *